US006057801A

United States Patent [19]

Desclos et al.

[11] Patent Number: 6,057,801

[45] Date of Patent: May 2, 2000

[54] MULTIPLE FREQUENCY ARRAY ANTENNA

[75] Inventors: Laurent Desclos; Mohammad Madihian, both of Tokyo, Japan

[73] Assignee: NEC Corporation, Tokyo, Japan

[21] Appl. No.: 09/139,323

[22] Filed: Aug. 25, 1998

[30] Foreign Application Priority Data

Aug. 27, 1997 [JP] Japan ..... 9-230618

[51] Int. Cl.[7] ..... H01Q 1/24

[52] U.S. Cl. ..... 343/700 MS

[58] Field of Search ..... 343/700 MS, 702, 343/795; H01Q 1/24

[56] References Cited

U.S. PATENT DOCUMENTS 4,929,959 5/1990 Sorbello et al. ..... 343/700 MS 5,523,768 6/1996 Hemmie et al. ..... 343/840

5,798,737 8/1998 Kanaba et al. ..... 343/702

*Primary Examiner*—Hoanganh Le

*Assistant Examiner*—Tho Phan

*Attorney, Agent, or Firm*—Whitham, Curtis & Whitham

[57] ABSTRACT

A small co-planar multiple frequency array antenna. Two printed antennae and a double U-shaped printed antenna are formed on a substrate. The projecting length D1 of the two printed antennae from the double U-shaped printed antenna, the longitudinal distance D2 and the transversal distance D3 between the two printed antennae and the double U-shaped printed antenna are adjusted to obtain the optimum matching for the resonance frequencies F1 and F2 (F1<F2). Here, D1 and the distance DD1 are adjusted to obtain a resonance peak at F2. F1 and F2 are determined by the length RL1, RL2 of the resonance edge portion of the double U-shaped printed antenna and the resonance edge portion of the two printed antennae. The width W1, W2 of the two printed antennae and the double U-shaped printed antenna are also adjusted to control the matching at F1 and F2.

3 Claims, 6 Drawing Sheets

MULTIPLE FREQUENCY ARRAY ANTENNA

BACKGROUND OF THE INVENTION

1. Field of the Invention

The present invention relates to a multiple frequency array antenna for mobile communication system.

2. Description of the Prior Art

There have been proposed various improvements concerning the multiple frequency array antenna in the field of the mobile communication.

Referring to FIG. 7, an example of a double frequency array antenna is explained, which is disclosed in "Two band cellular antenna" (M. Bodley et al., 1997 IEEE MTT-s International Topical Symp. on Technologies for Wireless Applications pp93–98).

A plurality of arrayed patch antennas 14 for frequency F1 in the above-mentioned two band cellular antenna is connected with distribution line 16 on substrate 17, and is fed by distribution line 16 which is a supply system. Similarly, a plurality of arrayed patch antennas 18 for frequency F2 is fed by the feeder system of distribution line 19 on substrate 17. These are guided to a two way supply network.

However, in the above-mentioned reference, the size of the whole device is too large for the mobile communication equipment, because the space for two or more antenna stacks according to the frequency multiplicity is required on the same substrate.

SUMMARY OF THE INVENTION

Therefore, an object of the present invention is to provide a small coplanar multiple frequency array antenna for personal communication.

In accordance with the present invention, there is provided a multiple frequency array antenna, wherein the two printed antennas 1 and double U-shaped printed antenna 2 are formed on substrate 5.

The multiple frequency array antenna comprises two printed antennas which are separated by the distance DD1; and double U-shaped printed antenna which is connected with a line fed by a port and surrounds the two printed antennas, wherein the two printed antennas and the double U-shaped printed antenna are formed on a substrate; the projecting length D1 (including zero) of the two printed antennas from the double U-shaped printed antenna, the longitudinal distance D2, and the transversal distance D3 between the two printed antennas and the double U-shaped printed antenna are respectively adjusted to obtain the optimum matching for the two different resonance frequencies F1 and F2 (F1<F2); the distance DD1 and the distance D1 are adjusted to obtain a resonance peak at the resonance frequency F2; the resonance frequencies F1 and F2 are determined by the length RL1 of the resonance edge portion of the double U-shaped printed antenna and by the length RL2 of the resonance edge portion of the two printed antennas; and the width W1 of the two printed antennas and the width W2 of the double U-shaped printed antenna are adjusted to control the matching for the resonance frequencies F1 and F2.

The multiple frequency array antenna of the present invention may be characterized in that more than two groups of a couple of the two printed antennas and the double U-shaped printed antenna are formed on the substrate; the projecting length D11 (including zero) of the two printed antennas from the double U-shaped printed antenna, the longitudinal distance D22 and the transversal distance D33 between the two printed antennas and the double U-shaped printed antenna are respectively adjusted to obtain the optimum matching for the two different resonance frequencies F1 and F2 (F1<F2); the distance DD1 and the projecting length D11 are adjusted in order to obtain a resonance peak at the resonance frequency F2; the resonance frequencies F1 and F2 are determined by the length RL1 of the resonance edge portion of the double U-shaped printed antenna and by the length RL2 of the resonance edge portion of the two printed antennas; and the width W11 of the two printed antennas and the width W22 of the double U-shaped printed antenna are adjusted to control the matching for the resonance frequencies F1 and F2.

Further, the multiple frequency array antenna of the present invention may be characterized in that a single patch antenna is sand-witched from right and left by a couple of the two printed antennas and the double U-shaped printed antenna; the sand-witch structures are arranged to form an array on the substrate; the distance between the resonance edge portion of the single patch antenna and the adjacent resonance edge portions of the two printed antennas is made equal to the distance DD1; the projecting length D11 (including zero) of the two printed antennas from the double U-shaped printed antenna, the longitudinal distance D22 and the transversal distance D33 between the two printed antennas and the double U-shaped printed antenna are respectively adjusted to obtain the optimum matching for the two different resonance frequencies F1 and F2 (F1<F2); the distance DD1 and the projection length D11 are adjusted to obtain a resonance peak at the resonance frequency F1; the resonance frequencies F1 and F2 are determined by the length RL1 of the resonance edge portion of the double U-shaped printed antenna and by the length RL2 of the resonance edge portion of the two printed antennas; and the width W31 of the two printed antennas and the width W32 of the double U-shaped printed antenna are adjusted to control the matching for the resonance frequencies F1 and F2.

The resonance frequency of a square patch antenna is determined by the length of the resonance edge portion. The feeder system provides a matching circuit which matches the input port with the free space through the radiation structure. The patch itself can be trimmed by the impedance determined by the length of the non- radiative edge portion. In the double U-shaped antenna, the larger patch resonates at the lower resonance frequency F1 and the smaller patch resonates at the higher resonance frequency F2, because the length of the radiation edge portion is usually a half guided wavelength. The weight of the feeder system and the distance between the elements are most important, when an array antenna is constructed. Particularly, the distance is designed on the basis of the arrangement of the patches.

The multiple frequency array antenna of the present invention can be used both for an up converter and for a down converter. Therefore, the present invention provides a low cost antenna, because specific designs are required for the up converter and the down converter, respectively. In other words, the up converter functions also as the down converter in the present invention, because the matching at the input and output terminals are adjusted for the intermediate frequency or the radio frequency. Furthermore, the present invention is applicable to the mixer for all the frequency bands around the designed multiple frequencies, because the trimming can be introduced around each frequency. In this case, any new design is not required for any specific frequency, whereby low cost fabrication is realized.

Furthermore, the matching frequency of the antenna circuit can be adjusted, because the matching frequency is shifted on the basis of the circuit element triggered by a voltage. The above-mentioned circuit element is a parallel connection of an inductance and an internal capacitance of the active element which resonates at different frequencies corresponding to the bias voltage.

PREFERRED EMBODIMENT OF THE INVENTION

Figure 1:
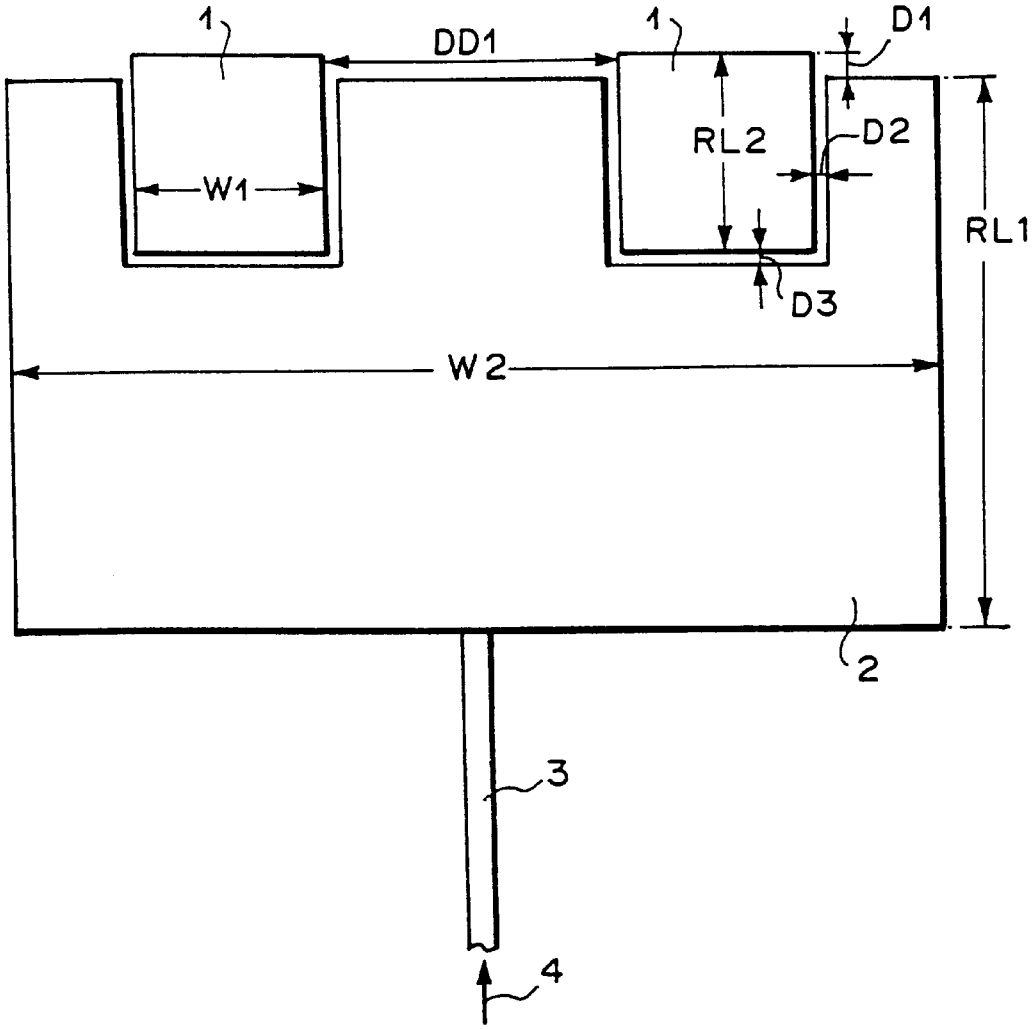
FIG. 1 is a plan view of the multiple frequency antenna of the present invention.

Referring to the drawings, the preferred embodiment of the present invention is explained. In a multiple frequency array antenna as shown in FIG. 1, the two metal printed antennas 1 are connected with line 3 which is fed by port 4. Further, double U-shaped printed antenna 2 surrounds the two printed antennas 1.

Figure 2:
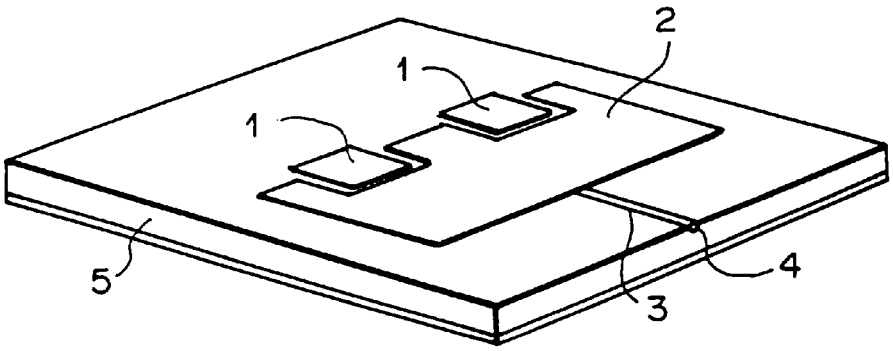
FIG. 2 is a perspective illustration of the antenna as shown in FIG. 1.

As shown in FIG. 2, the two printed antennas 1 and double U-shaped printed antenna 2 are formed on substrate 5.

The projecting length D 1 (including zero) of the two printed antennas 1 from double U-shaped printed antenna 2, the longitudinal distance D2 and the transversal distance D3 between the two printed antennas and double U-shaped printed antenna 2 are adjusted to obtain the optimum matching for the two different resonance frequencies F1 and F2 (F1<F2). Here, the resonance frequencies F1 and F2 are determined by the length RL1 of the resonance edge portion of double U-shaped printed antenna 2 and by the length RL2 of the resonance edge portion of the two printed antennas 1. Further, the width W1 of two printed antennas 1 and the width W2 of double U-shaped printed antenna 2 are also adjusted to control the matching for the resonance frequencies F1 and F2.

Figure 3:
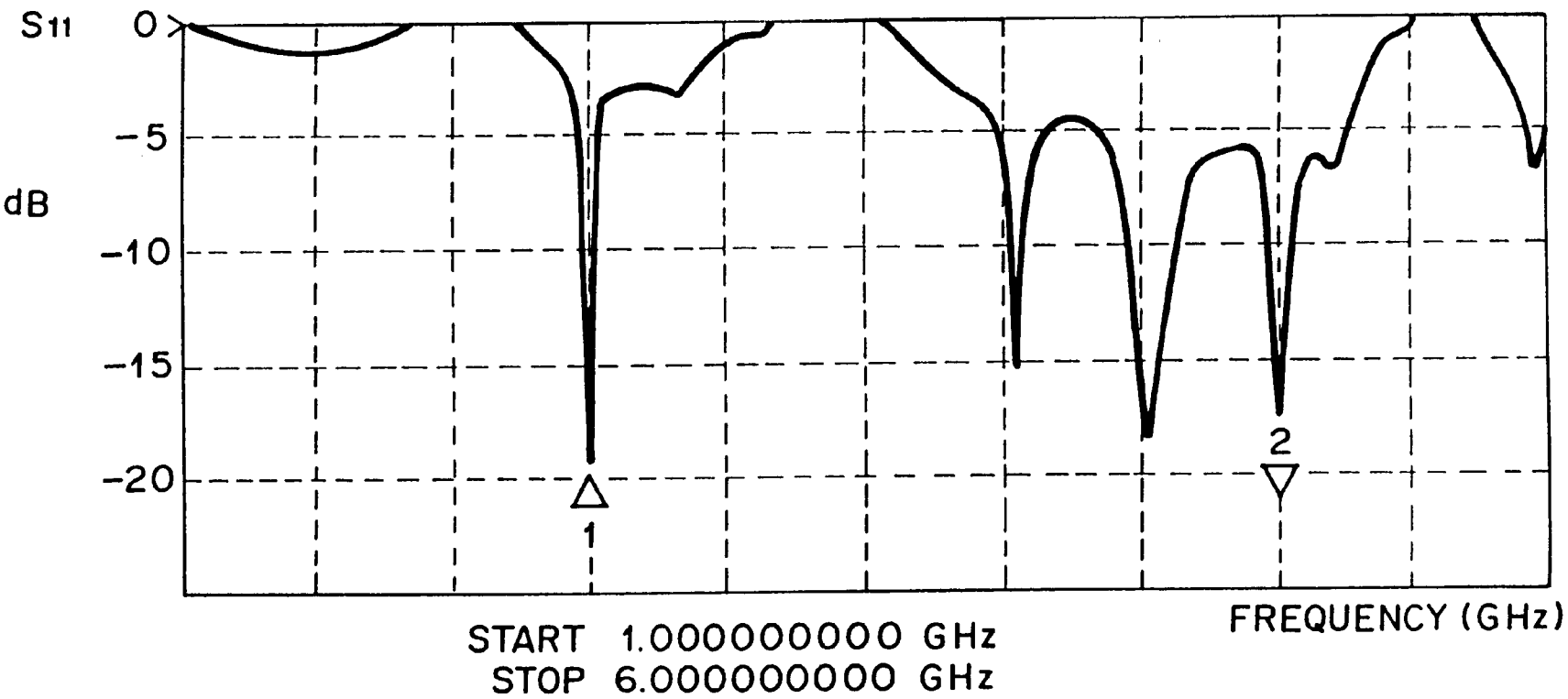
FIG. 3 is a measurement result of the matching of the antenna as shown in FIG. 1.

An example of a measurement result of matching is shown in FIG. 3. In the measurement, the length RL2 of the two printed antennas 1 is 15 mm, the width W1 is 11 mm and the distance DD1 is 1.8 mm. The width of the outer surrounding of double U-shaped printed antenna is 3 mm, the width of the inner surrounding is 11.2 mm, the length RL1 of the resonance edge is 31.7 mm and the width W2 is 40.4 mm. The projection length D1 is zero, although it is illustrated as nonzero. The distance D2 is 0.3 mm and the distance D3 is 0.7 mm. These three antennas with the dielectric constant 3.38 and the thickness 1.6 mm are printed on substrate 5. The matching of this structure is greater than 19 dB for 2.5 GHz of the first resonance frequency F1 and is about 21 dB for 5 GHz of the second resonance frequency F2.

The gain of this structure is the same as the bi-directional high frequency antenna and the conventional single patch low frequency antenna.

Figure 4:
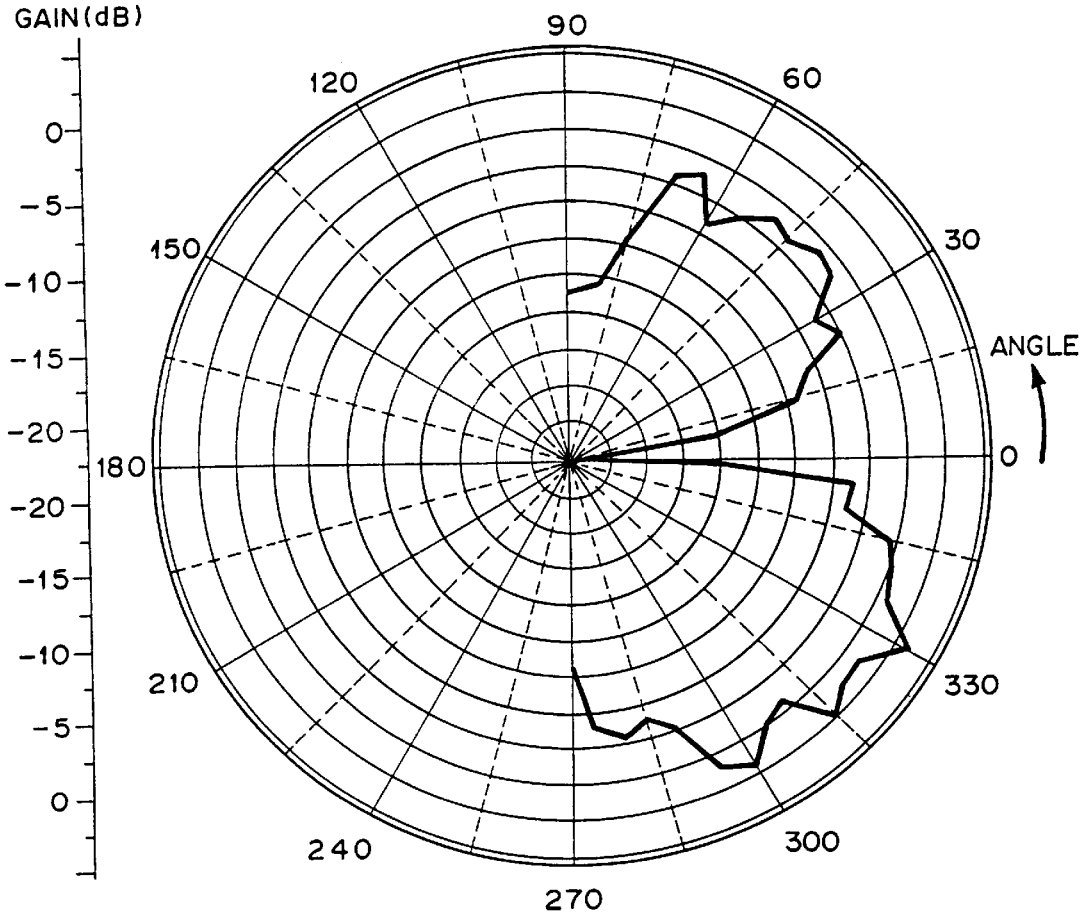
FIG. 4 is an example of the radiation pattern of the antenna as shown in FIG. 1.

The radiation pattern of the embodiment as shown in FIG. 1 is shown in FIG. 4.

Figure 5:
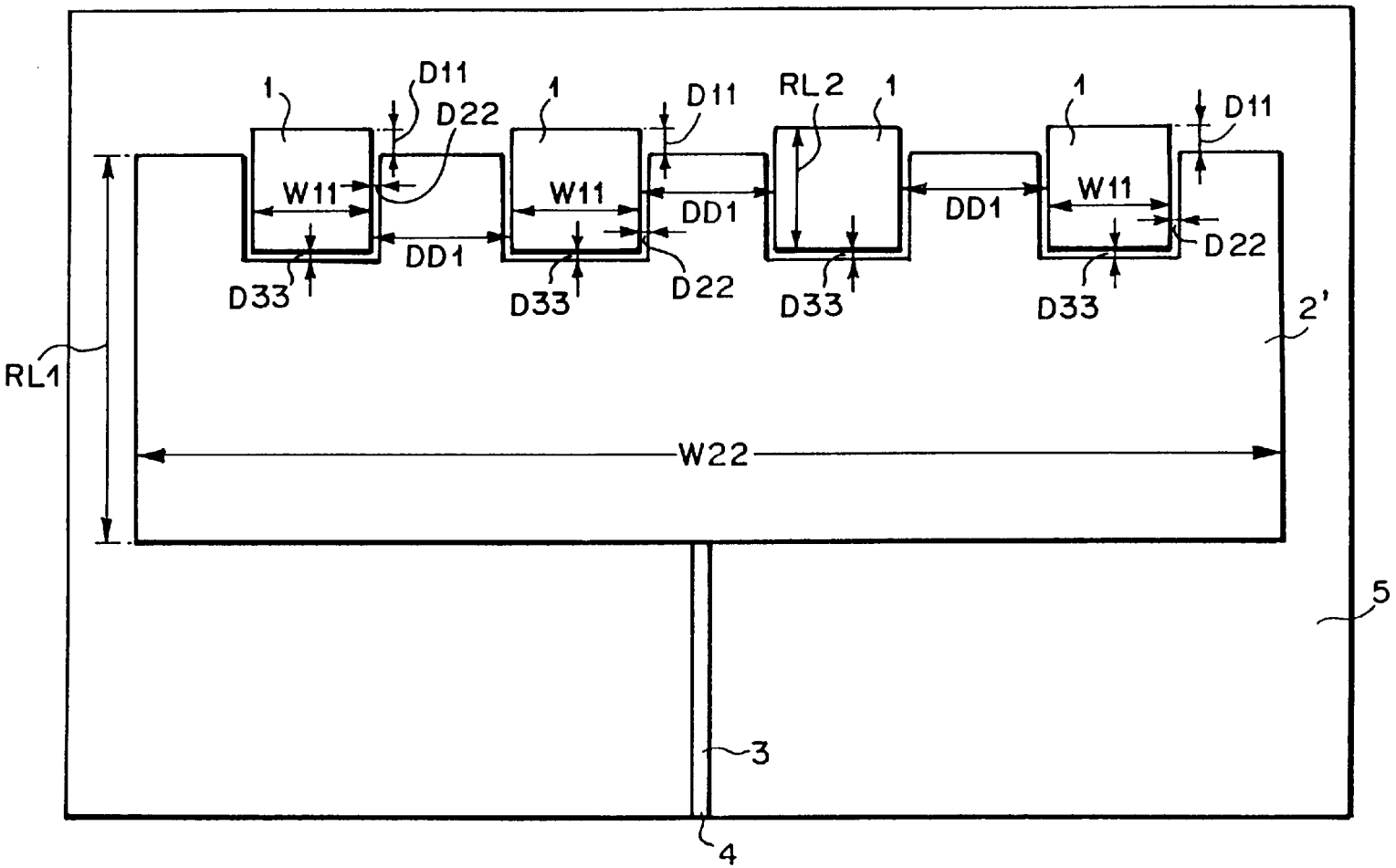
FIG. 5 is a plan view of an antenna by another embodiment of the present invention.

Furthermore, another embodiment of the present invention is shown in FIG. 5. In this embodiment, two or more couples of the two printed antennas and double U-shaped printed antenna 2 are formed on substrate 5, although only the two groups are illustrated in FIG. 5.

The projecting length D11 (including zero) of the two printed antennas 1 from double U-shaped printed antenna 2', the longitudinal distance D22 and the transversal distance D33 between the two printed antennas 1 and double U-shaped printed antenna 2' are adjusted to obtain the optimum matching for the two different resonance frequencies F1 and F2 (F1<F2). Here, the distance DD1 and the projection length D11 are adjusted in order to obtain a peak at the resonance frequency F2. Further, the resonance frequencies F1 and F2 are determined by the length RL1 of the resonance edge portion of double U-shaped printed antenna 2 and by the length RL2 of the resonance edge portion of the two printed antennas 1. Further, the width W11 of the two printed antennas 1 and the width W22 of double U-shaped printed antenna 2' are also adjusted to control the matching for the resonance frequencies F1 and F2.

Figure 6:
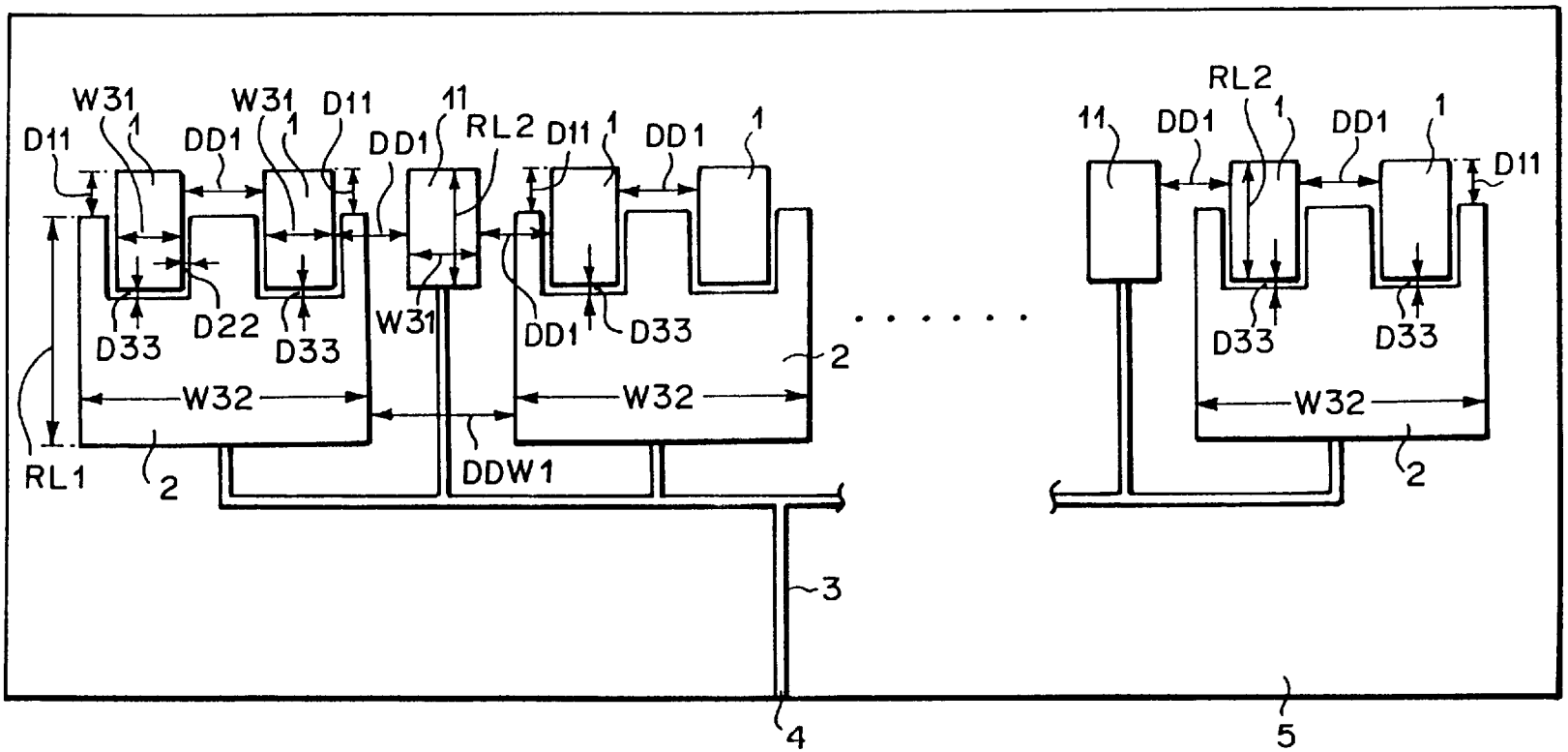
FIG. 6 is a plan view of an antenna by still another embodiment of the present invention.
Figure 7:
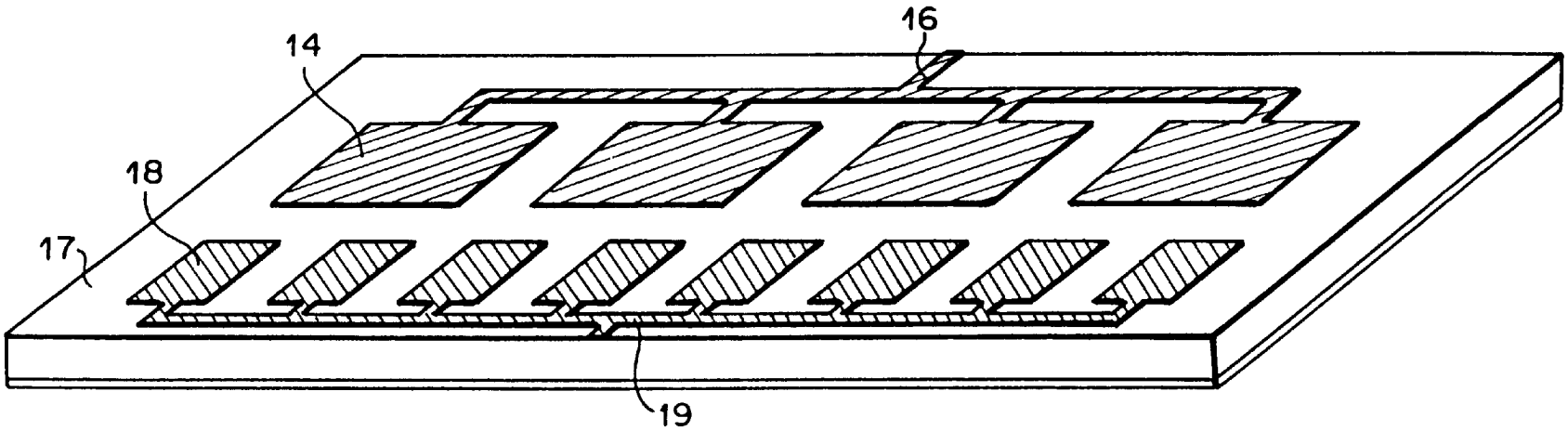
FIG. 7 PRIOR ART
FIG. 7 is an illustration of an example of a conventional antenna.

In still another embodiment of the present invention as shown in FIG. 6, a single patch antenna is sand-witched from right and left by the couples of the two printed antennas 1 and double U-shaped printed antenna 2. The sand-witched structures are arranged to form an array on substrate 5.

The distance between the resonance edge of single patch antenna 11 and the adjacent resonance edges of the two printed antennas 1 is made equal to the distance DD1. The projecting length D11 (including zero) of the two printed antennas 1 from double U-shaped printed antenna 2, the longitudinal distance D22 and the transversal distance D33 between the two printed antennas 1 and double U-shaped printed antenna 2 are adjusted to obtain the optimum matching for the two different resonance frequencies F1 and F2 (F1<F2). Here, the distance DD1 and the projection length D11 are adjusted in order to obtain a peak at the lower resonance frequency F1. Further, the resonance frequencies F1 and F2 are determined by the length RL1 of the resonance edge portion of double U-shaped printed antenna 2 and by the length RL2 of the resonance edge portion of the two printed antennas 1. Further, the width W31 of the two printed antennas 1 and the width W32 of double U-shaped printed antenna 2 are also adjusted to control the matching for the resonance frequencies F1 and F2.

Although the present invention has been shown and described with respect to the best mode embodiment thereof, it should be understood by those skilled in the art that the foregoing and various other changes, omissions, and additions in the form and detail thereof may be made therein without departing from the spirit and scope of the present invention.

What is claimed is:

1. A multiple frequency array antenna which comprises:

two printed antennas which are separated by a distance; and a double U-shaped printed antenna which is connected with a line fed by a port and surrounds said two printed antennas, wherein:

said two printed antennas and said double U-shaped printed antenna are formed on a substrate;

a projecting length (including zero) of said two printed antennas from said double U-longitudinal antenna, a longitudinal distance, and a transversal distance between said two printed antennas and said double U-shaped printed antenna are respectively adjusted to obtain the optimum matching for two different resonance frequencies F1 and F2 (F1<F2);

said distance and said projecting length are adjusted to obtain a resonance peak at said resonance frequency F2;

said resonance frequencies F1 and F2 are determined by a length of a resonance edge portion of said double U-shaped printed antenna and by a length of the resonance edge portion of said two printed antennas; and a width of said two printed antennas and a width of said double U-shaped printed antenna are adjusted to control the matching for the resonance frequencies F1 and F2.

2. The multiple frequency array antenna according to claim 1, wherein:

two or more groups of a couple of said two printed antennas and said double U-shaped printed antenna are formed on said substrate;

the projecting length (including zero) of said two printed antennas from said double U-shaped printed antenna, the longitudinal distance and the transversal distance between said two printed antennas and said double U-shaped printed antenna are respectively adjusted to obtain the optimum matching for said two different resonance frequencies F1 and F2 (F1<F2);

said distance and said projecting length are adjusted in order to obtain a resonance peak at said resonance frequency F2; and the width of said two printed antennas and the width of said double U-shaped printed antenna are adjusted to control the matching for said resonance frequencies F1 and F2.

3. The multiple frequency array antenna according to claim 1, wherein:

a single patch antenna is sand-witched from right and left by a couple of said two printed antennas and said double U-shaped printed antenna;

the single patch antenna sand-witched from right and left by the couple of said two printed antennas and said double U-shaped antenna are arranged to form an array on said-substrate;

a distance between the resonance edge portion of said single patch antenna and the adjacent resonance edge portions of said two printed antennas is made equal to said distance;

the projecting length (including zero) of said two printed antennas from said double U-shaped printed antenna, the longitudinal distance and the transversal distance between said two printed antennas and said double U-shaped printed antenna are respectively adjusted to obtain the optimum matching for said two different resonance frequencies F1 and F2 (F1<F2);

said distance and said projection length are adjusted to obtain a resonance peak at said resonance frequency F1;

the width of said two printed antennas and the width of said double U-shaped printed antenna are adjusted to control the matching for said resonance frequencies F1 and F2.

* * * * *